US010925379B1

(12) United States Patent
Fulbrook

(10) Patent No.: US 10,925,379 B1
(45) Date of Patent: Feb. 23, 2021

(54) THERMALLY INSULATED FANNY PACK CONTAINMENT SYSTEM

(71) Applicant: Jim E. Fulbrook, Fairfax, VA (US)

(72) Inventor: Jim E. Fulbrook, Fairfax, VA (US)

(73) Assignee: Efficiency Products, LLC, Fairfax, VA (US)

( * ) Notice: Subject to any disclaimer, the term of this patent is extended or adjusted under 35 U.S.C. 154(b) by 0 days.

(21) Appl. No.: 16/832,829

(22) Filed: Mar. 27, 2020

(51) Int. Cl.
*A45F 3/00* (2006.01)

(52) U.S. Cl.
CPC ..... *A45F 3/005* (2013.01); *A45F 2200/0583* (2013.01)

(58) Field of Classification Search
CPC ..... A45F 3/005
USPC ..... 224/660
See application file for complete search history.

(56) References Cited

U.S. PATENT DOCUMENTS 1,809,696 A * 6/1931 Heilweil ..... A45C 11/22 206/37
3,155,260 A * 11/1964 Widener ..... A47J 41/0044 215/12.1
3,730,374 A * 5/1973 Picciano ..... B65D 81/07 220/592.15
3,910,470 A * 10/1975 Swenson ..... A45C 11/38 224/610
4,119,248 A 10/1978 BUtler et al.
5,135,144 A 8/1992 Biakely et al.
5,216,900 A * 6/1993 Jones ..... A45C 11/20 224/148.3
5,390,791 A 2/1995 Yeager
5,397,040 A * 3/1995 Lee ..... A01K 97/06 206/315.11
6,067,813 A 5/2000 Smith
6,293,445 B1 9/2001 Miller
6,832,712 B2 12/2004 Turner
9,522,772 B2 * 12/2016 Fu ..... B65D 5/667
2005/0116003 A1 * 6/2005 Butler ..... A45F 5/02 224/604
2006/0011686 A1 * 1/2006 Latham ..... B60R 7/04 224/579
2008/0093384 A1 * 4/2008 Fire ..... B67D 1/0412 222/144.5
2011/0215125 A1 * 9/2011 Lopez ..... A45C 13/103 224/576

(Continued)

*Primary Examiner* — Nathan J Newhouse
*Assistant Examiner* — Lester L Vanterpool
(74) *Attorney, Agent, or Firm* — Invention To Patent Services; Alex Hobson

(57) ABSTRACT

A thermally insulated fanny pack containment system provides secure containment of temperature sensitive articles in either hot or cold environments by utilizing a rigid double wall bin portion that has an insulating gap between the inner and outer walls. A cover, which is also rigid double wall construction is configured to extend over the top opening of the bin portion and latch down to secure the cover over the bin portion. A belt is coupled to the bin portion and is configured to extend around a person's waist. One or more detachably attachable thermal liners that are chilled or heated may be configured to fit within the bin portion to control the temperature within the interior of the bin portion enclosure. The thermal liners may have fasteners for securing an article within the bin portion. A bottle-in-bottle may be utilized to prevent moisture exposure to contents therein.

27 Claims, 6 Drawing Sheets

(56) References Cited

U.S. PATENT DOCUMENTS

| | | | | |
|---|---|---|---|---|
| 2013/0310802 | A1 | 11/2013 | Weinmann | |
| 2014/0140643 | A1* | 5/2014 | Li | A45C 9/00 383/111 |
| 2015/0008242 | A1* | 1/2015 | Kpabar, Jr. | B67D 3/0061 222/183 |
| 2018/0299059 | A1* | 10/2018 | McGoff | B65D 90/046 |

* cited by examiner

THERMALLY INSULATED FANNY PACK CONTAINMENT SYSTEM

BACKGROUND OF THE INVENTION

Field of the Invention

The invention relates to a thermally insulated fanny pack containment system that provides a secure means for people to carry moisture sensitive and temperature sensitive items in either cold or hot environments.

Background

There are many humidity and/or temperature sensitive items that require storage and containment within a range of temperatures to avoid damage or spoiling. For example, some medications are required to be maintained within a particular temperature range to avoid loss of activity and therapeutic effects or to avoid melting. High temperatures can change the composition of chemical substances and or cause them to melt. Cold temperatures can cause liquid substance to freeze, including medications and sprays that may be needed for respiratory conditions. Furthermore, some medications are water soluble or have water soluble capsules that dissolve or stick together when exposed to condensation in a chilled enclosure. In addition, some electronics and film materials can become damaged or stop operating when maintained outside of an operating temperature range or exposed to condensation. Some of these items, such as medications, are required to be on hand and available in case they are needed. For example, certain medications such as an inhaler or injectable epinephrine device, may be needed by an individual at any time, especially when outdoors. This can greatly limit a person's range of activities when outdoor temperatures are outside of recommended temperature limits for these items. When these items are required during outdoor activities outside of the recommended temperatures ranges, the items may be kept in a cooler, but coolers are cumbersome and awkward to carry. A small cooler may be placed inside a backpack, but this also limits mobility and a backpack can be very hot and uncomfortable, especially on hot days.

SUMMARY OF THE INVENTION

The invention is directed to a thermally insulated fanny pack containment system the provides secure containment of temperature sensitive articles in either hot or cold environments. An exemplary thermally insulated fanny pack container comprises a rigid double wall bin portion for receiving and retaining items therein. The rigid double wall may be filled with an insulating material or a gas to provide thermal insulation of the bin. A cover may be configured to extend over the top opening of the bin portion and the cover may also be a rigid double wall construction. A belt may be coupled to the bin and be configured to extend around a person's waist to secure the thermally insulated fanny pack container to the person's waist. A person may place thermally sensitive items in the bin portion and carry these items hands free. One or more detachably attachable thermal liners may be configured to fit within the bin portion to control the temperature within the interior of the bin portion enclosure. The thermal liners may be chilled or heated prior to insertion into the bin portion.

An exemplary bin portion may be rigid, wherein it is made out of a rigid material such as metal. The rigid double wall bin portion may have an inner wall separated from an outer wall by an insulating gap, which is a sealed volume of space that may include an insulating material, such as a gas or gel. An insulating gap may be filled with an insulating gas, such as argon, helium, krypton or xenon, and these gases may be inert noble gases that are non-reactive. Note that an insulating gap may be substantially void of any insulating material and may be under a vacuum, wherein the insulating gap is below ambient atmospheric pressure. A vacuum space is a very thermally insulating layer. The insulating gap may be maintained by the rigid interior and exterior walls of the bin portion, which may be metal, to prevent gas from diffusing out of the insulating gap or diffusing into the insulating gap. An insulating gap, or distance between the inner wall and outer wall of the bin portion, may be about 3 mm or more, about 5 mm or more about 10 mm or more, about 15 mm or more and any range between and including the insulating gap distances provided.

The rigid double wall bin portion may be a shape that is conducive for carrying around a person's waist and for retrieving articles therefrom. The back side of the rigid double wall bin portion may be substantially straight or planar or may have a slight curve for extending around a portion of a person's waist, such as a concave curve for extending around a hip portion of a person's waist, The front side of the rigid double wall bin portion may be curved from one side to the other thereby eliminating any corners along the front side. The front side of the bin portion may extend substantially along a radius of curvature, wherein at least 60% of the front side is curved along a radius of curvature. The widest portion of the bin portion may be centrally located along the curved front side of the bin portion. This shape may be more conducive for placing and retrieving articles in the bin and is conducive to carrying around a person's waist, as the curved front side will not be intrusive or catch on items due to sharp edges.

The size of the thermally insulated fanny pack container, or bin portion, may be selected depending on the activity and the size and quality of items desired to be contained therein. For example, a hiker in the desert of Arizona, may choose a thermally insulated fanny pack container that is small, such as less than about 150 mm in length, to carry only the one or two required medications that need to be maintained within a recommended temperature range. An exemplary thermally insulated fanny pack container may be sized to allow for multiple cylindrical containers, a drink or medication, to be carried and these cylindrical containers may be about six to twelve ounces in volume. An exemplary thermally insulated fanny pack container may be configured to carry food, such as a sandwich or bar which may be required for diabetics to maintain sugar levels. The width of the bin portion may be about 200 mm or less, about 150 mm or less, about 100 mm or less, about 75 mm, about 50 mm or less and any range between and including the length values provided. The length of the bin portion may be about 300 mm or less, about 250 mm or less, about 200 mm or less, about 150 mm, about 100 mm or less and any range between and including the length values provided. The height of the bin portion may be about 200 mm or less, about 150 mm or less, about 100 mm or less, about 75 mm, about 50 mm or less and any range between and including the length values provided.

An exemplary cover may be a rigid double wall cover as described for the rigid double wall bin portion. The cover may be hinged along the back side of the bin portion to allow the cover to open up toward a person when donned around said person's waist. The cover may be curved and match the shape of the bin portion. The front portion of the cover may extend along a radius of curvature. A seal may be configured between the cover and the bin portion to prevent air exchange between the interior of the bin portion and the outside environment. A latch may be configured to secure the cover down over the bin portion and this latch or latches may be configured along the front side of the bin portion. A latch may compress a gasket configured between the cover and the bin portion to produce a sealed bin portion having no or minimal air leakage. The gasket may be a resilient or elastomeric material, such as a foam, silicone, urethane and the like. A resilient material is one that returns substantially, within 10%, to an original shape after removal of a deforming load. For example, a gasket may be compressed between the cover and the bin portion by the latches and then return to an uncompressed state upon opening the cover.

An exemplary thermally insulated fanny pack containment system may further incorporate a detachably attachable perimeter thermal liner that is configured to extend along at least a portion of the inside perimeter of the bin portion. A perimeter thermal liner may be configured as a strip of material having hook and loop fasteners on either end for coupling the strip ends into a loop that extends along the inside perimeter of the bin portion. The perimeter thermal liner may extend completely around the inside perimeter of the bin portion or a substantial portion of the inside perimeter or inner wall of the bin portion, or at least 75% of the inside perimeter and more preferably at least 90% of the inside perimeter. The thermal liner may have hook-and-loop fasteners that detachably attach the thermal liner to bin portion hook-and-loop fasteners configured along the inside perimeter of the bin portion. Likewise, a thermally insulated fanny pack containment system may incorporate a base thermal liner that is configured along the base of the bin portion and may be detachably attachable to the interior base of the bin portion. Again, a base thermal liner may have hook-and-loop fasteners configured to couple with a bin portion hook-and-loop fasteners configured on the interior base of the bin portion. The base thermal liner, when attached, may further attach to the articles or an article liner to retain the articles to the base and prevent them from jostling in the bin portion. The thermal liners may be enclosures that contain a thermally insulating material, such as gel.

An exemplary thermally insulated fanny pack containment system may further utilize an article liner that is configured to extend around an article placed in the rigid double wall bin portion. An article liner may be shaped to retain an article therein and may be cylindrically shaped to fit around a bottle, for example. An exemplary article liner may incorporate a hook-and-loop fastener configured on an exterior surface that is configured to detachably attach to a hook-and-loop fastener configured on an interior surface of the thermal liner, or surface exposed to the interior of the bin portion when the thermal liner is configured in the bin portion. An article liner may be enclosures that contain a thermally insulating material, such as gel.

An exemplary thermal insulating material that at may be configured in a pouch of a thermal liner or article liner is a gel. Gels are well known for providing effective thermal control properties as they have a high heat capacity. Gels are often a non-toxic material that are a high viscosity gel, and therefore will not spill easily or cause contamination if the pouch breaks. Gel may comprise a mixture of water with hydroxyethyl cellulose, sodium polyacrylate, or vinyl-coated silica gel. One gram of sodium polyacrylate can absorb 300-1000 grams of pure water. A thermal liner may include an instant gel pouch, or a pouch that has two ingredients that when mixed rapidly cool such as water and ammonium nitrate, calcium ammonium nitrate or urea. The water may be separated from the cooling component by a bag and when the bag is broken, such as by squeezing the package, cooling component mixes with the water in an endothermic reaction. An endothermic reaction absorbs heat from the surroundings, thereby quickly reducing the thermal liner temperature.

An exemplary thermal liner may be heated or cooled prior to placement inside of the bin portion. For example, a hiker in Arizona may place one or more of the thermal liners in a refrigerator to cool the thermal liner prior to placing them in the bin portion. In this way, the items configured in the bin portion may be maintained at a lower temperature than the very hot conditions during the hike. Likewise, a person taking a walking tour, of Milwaukee in the winter may require a spray inhaler that does not function below freezing conditions and therefore a person may place a thermal liner in heated water, prior to placing them in the bin portion. Some thermal liners are recommended for heating applications to about 150 degrees. Therefore, when warming is desired, the user may heat the thermal liner to about 120-130 degrees to avoid damage.

The thermally insulated fanny pack containment system may include a bottle-in-bottle that further insulates articles retained therein and also is configured to prevent condensation within the inner bottle. A bottle-in-bottle comprises an outer bottle wall configured around an inner bottle wall. The inner bottle wall has an opening and cap configured to seal the inner bottle from the void space between the inner bottle and the outer bottle. A desiccant may be configured in this void space to further control and reduce moisture to prevent condensation and damage due to high moisture levels. In addition, both the outer bottle and inner bottle may have a moisture barrier cap seal that effectively prevents moisture from passing into the bottle through the cap. A retainer gasket may be configured on an inside surface of the outer bottle cap to engage with the inner bottle to retain the inner bottle in a compression within the outer bottle.

Rigid, as used herein to describe the double wall bin and/or cover, is free standing, retains a shape and is not easily deformed, whereby it cannot be bent by hand unlike as a fabric or sheet of plastic material and may be made out of metal.

A belt, as used herein, is an elongated flexible member, such as a fabric that can be wrapped around a person's torso or another item to retain the fanny pack thereto.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
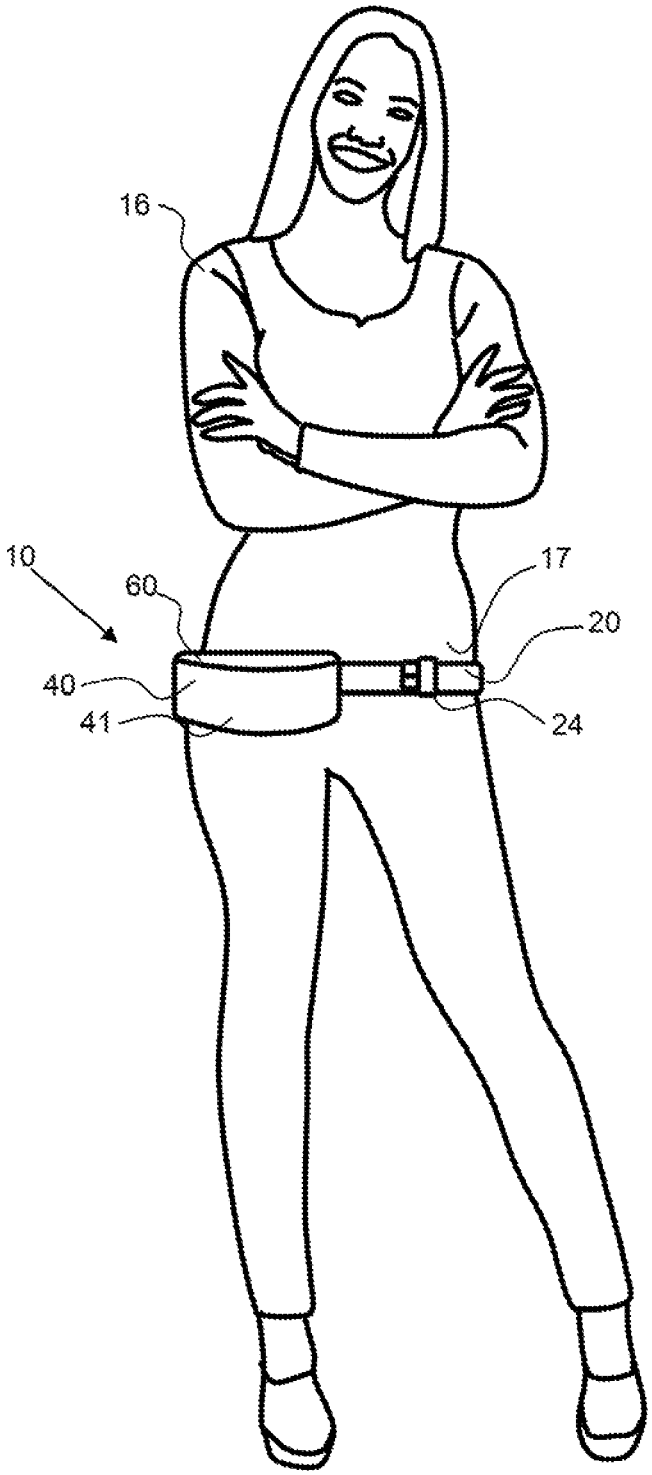
FIG. 1 shows a front view of a person donning an exemplary fanny pack system comprising a double wall bin portion that is coupled to a belt that extends around the person's waist and a cover that opens for retrieving contents from the fanny pack.

Corresponding reference characters indicate corresponding parts throughout the several, views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
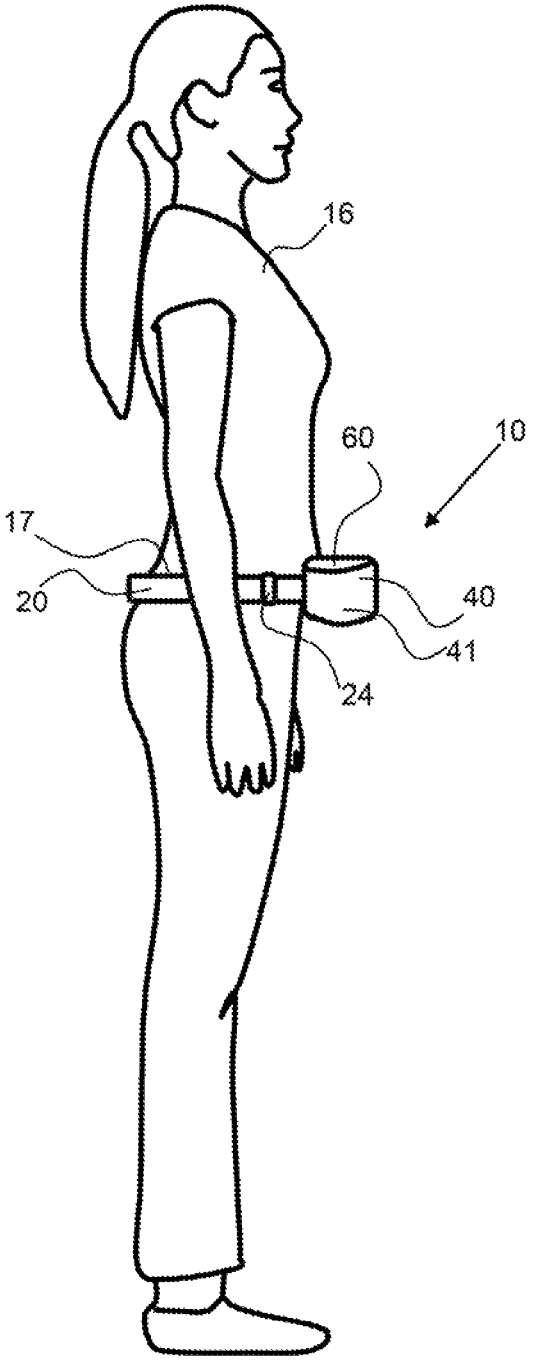
FIG. 2 shows a side view of a person donning an exemplary fanny pack system comprising a double wall bin portion that is coupled to a belt that extends around the person's waist and a cover that opens for retrieving contents from the fanny pack.

Referring to FIGS. 1 and 2, a person 16 is donning an exemplary fanny pack system 10. The thermally insulated fanny pack container 40 comprises a double wall bin portion 41 that is coupled to a belt 20, that extends around the person's waist 17 and is secured together by the buckle 24. A cover 60 is coupled to the bin portion and opens for retrieving items in the container. The belt may be coupled by a buckle and the belt or strap may be pulled through the buckle to tighten the belt around a person's waist.

Figure 3:
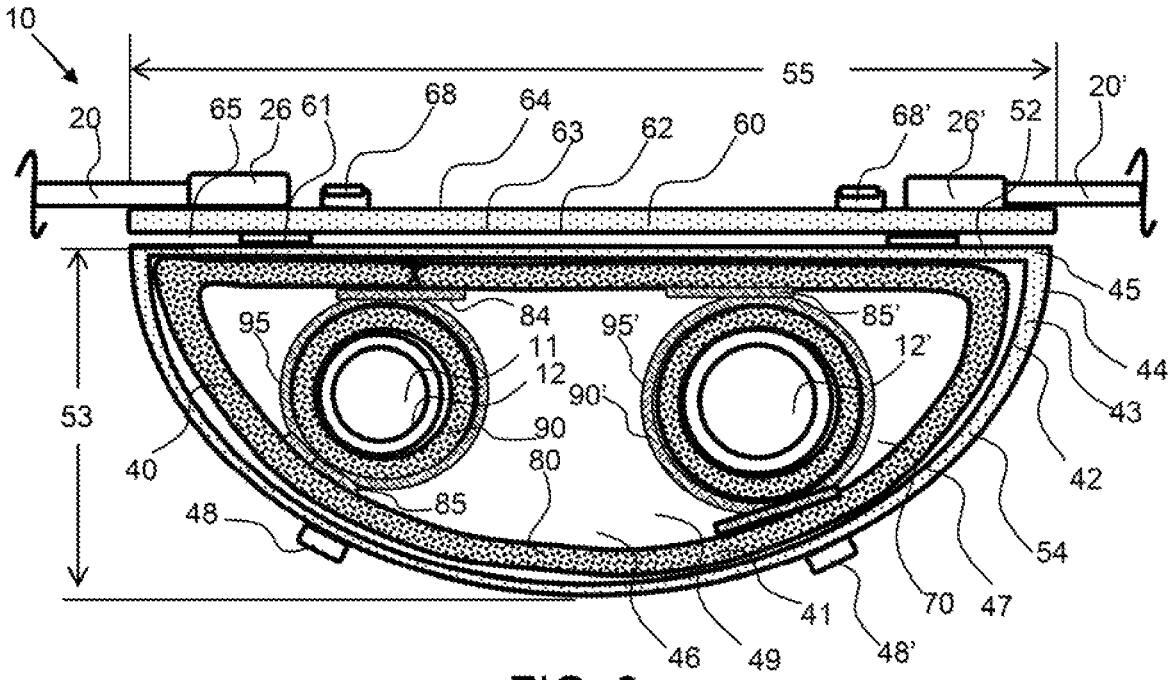
FIG. 3 shows a top view of an exemplary fanny pack system with the cover open wherein a thermal liner extends around the inside perimeter of the double wall bin portion and wherein two articles that are encircled by an article liner having a thermally insulating material therein, are retained to the thermal liner by hook-and-loop fasteners.
Figure 4:
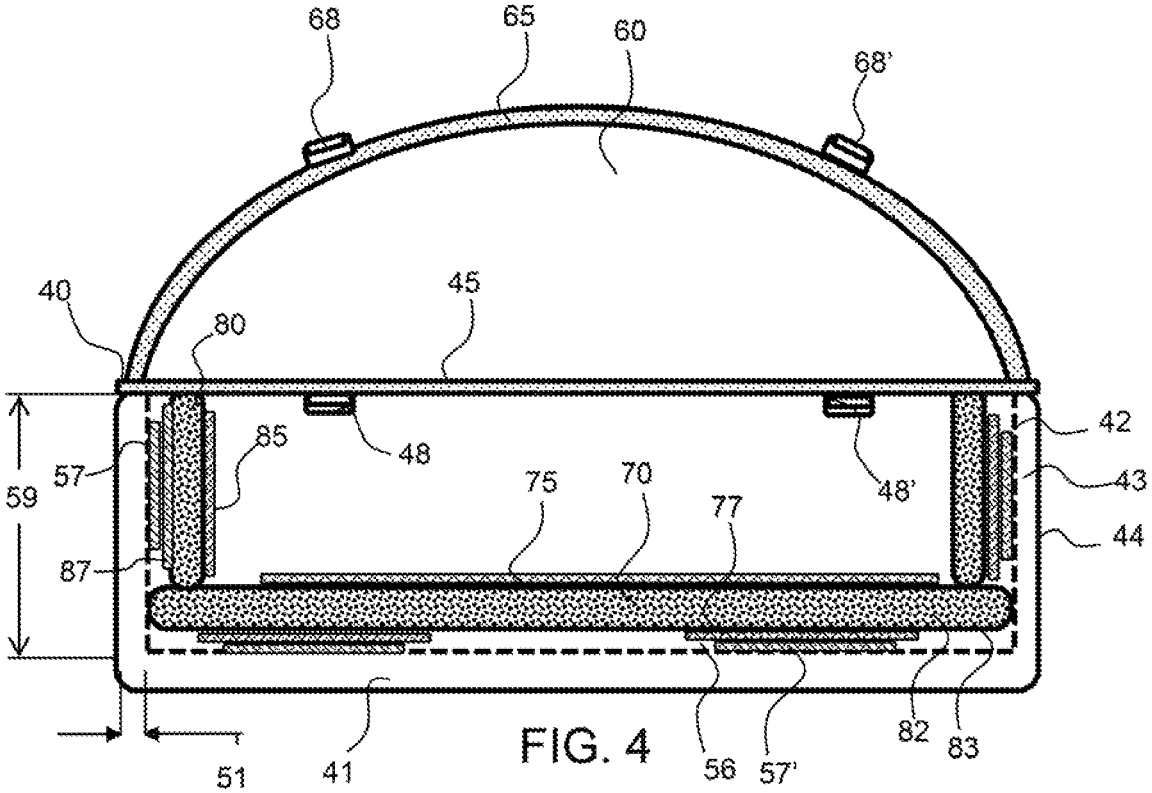
FIG. 4 shows a front cross-sectional view of an exemplary fanny pack system with the cover open and a base thermal liner configured in the bottom of the interior of the double wall bin portion. A perimeter thermal liner, such as a gel pack, lines the entire inside vertical walls around the fanny pack container as well.

Referring now to FIGS. 3 and 4, an exemplary fanny pack system 10 has a cover 60 configured to close down over the top opening 49 of the double wall bin portion 41 of the thermally insulated fanny pack container 40 by a hinge 61. A cover gasket 65 may seal with a bin gasket 45 when the cover is closed and the latches 68, 68' are coupled with the latch 48, 48' of the bin portion, respectively. The cover may be a rigid cover and may be a double wall cover having a gas gap 63 between an inner wall 62 and outer wall 64. Likewise, the double wall bin portion 41 may have a gas gap 43 between an inner wall 42 and outer wall 44 and the bin portion may be rigid. The double wall cover and bin may be made out of metal to reduce any permeation of gas therethrough. The bin portion has a back side 52 that may be planar and a front side 54 that may be curved and extend along a radius of curvature, as shown. The thermally insulated fanny pack container 40 or the double wall bin portion has a width 53, length 55 and height 59 that may be conducive for carrying around a person's waist by the belt 20.

Within the interior 46 of the double wall bin portion, a perimeter thermal liner 80 is configured around the inside perimeter 47 of the bin portion. A connecting fastener 84 is configured to hold the two ends of the thermal liner 80 together as the liner runs along the vertical sides within the bin portion. The perimeter thermal liner may have bin fasteners 87 for connecting the perimeter thermal liner to bin portion fasteners 57 coupled to the inner wall 42 of the bin portion 41. The perimeter thermal liner may also have interior fasteners 85, 85' for detachable attachment to an article fastener 95, 95', as shown in FIG. 3. The article fasteners are configured around the bottles 12, 12'. Also, a base thermal liner 70 is configured in the base 56 of the bin portion. The base thermal liner may also have bin fasteners 77 for detachably attaching to the bin portion fasteners 57', as shown in FIG. 4. The base thermal liner may also have interior fasteners 75 for detachably attaching to an article fastener 95. Any of the fasteners mentioned herein may be hook-and-loop fasteners. An article 11, such as a bottle 12 may be configured in an article liner 90 that forms a cylindrical opening for receiving the bottle. Along the exterior of the article liner, an article fastener 95 may enable the article to be retained to the perimeter thermal liner and/or the base thermal liner. The article fastener may extend completely around the article liner. The bottle may be securely retained in the interior of the bin portion even during vigorous activity. This secure retention of the article 11 may prevent damage to the article. Any of the thermal liners, the perimeter thermal liner, base thermal liner and/or the article thermal liner may be chilled or heated prior to locating in the bin portion. A thermal liner may be a gel pack having a liner pouch 82 containing an insulating material 83, such as a gel that is chilled or heated prior to placing it in the bin portion.

Medication bottles 12, 12' are retained in the article thermal liners 90, 90', respectively, configured around the bottle. Again, the article thermal liner as an article fastener 95' that is detachably attached to the interior fastener 85' of the perimeter thermal liner 80 and/or the interior fastener 75 of the base thermal liner 70.

The interior wall 42 may be separated from the exterior wall 44 by an insulating gap 43 having a gap distance 51 therebetween. This insulating gap may be configured as a void and be under vacuum, or contain a gas, such as a noble gas as described herein.

Figure 5:
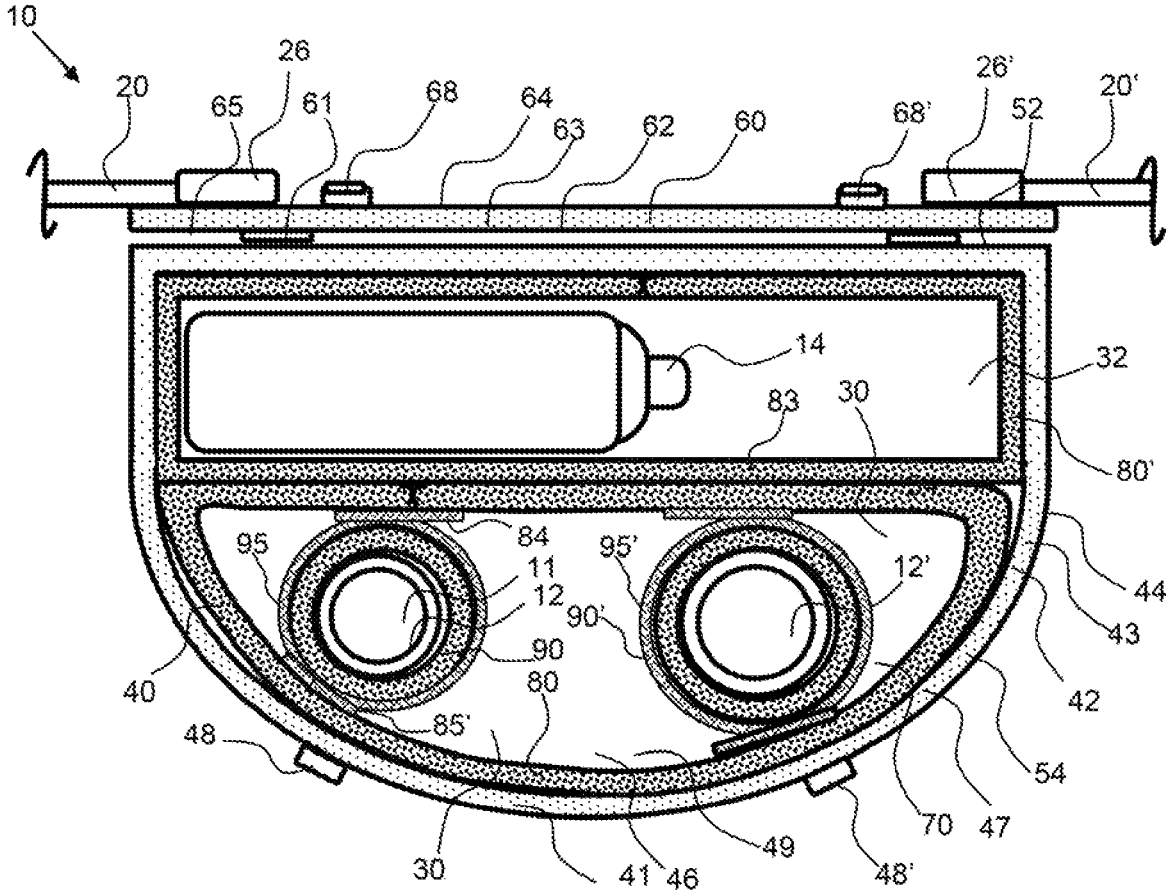
FIG. 5 shows an exemplary top view of an exemplary fanny pack system with the cover open and two perimeter areas formed by perimeter thermal liners.
Figure 6:
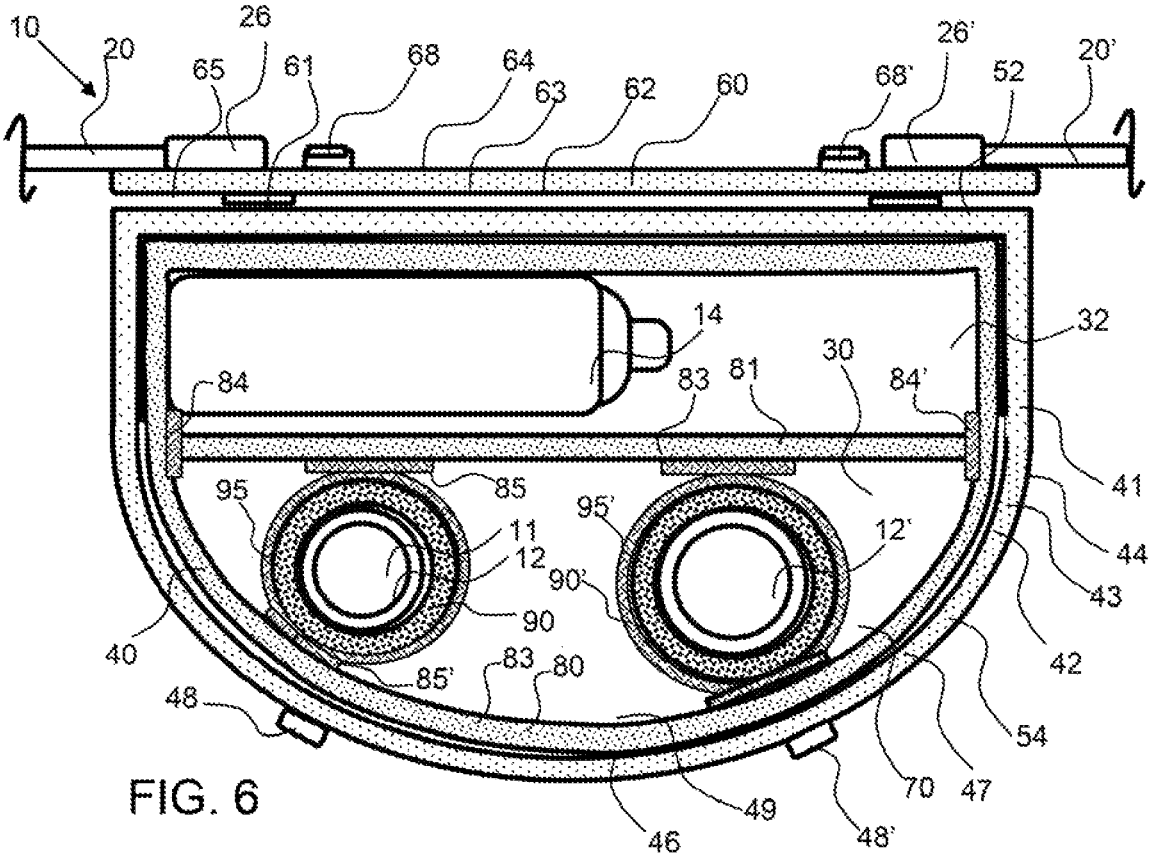
FIG. 6 shows an exemplary top view of an exemplary fanny pack system with the cover open and two perimeter areas formed by a perimeter thermal liner and a partition liner.

As shown in FIGS. 5 and 6, an exemplary fanny pack system 10 has two perimeter areas that are formed by thermal liners 80, 80'. As shown in FIG. 5, a first perimeter area 30 is formed or defined by the first perimeter thermal liner 80 and retains two bottles 12, 12', which may contain medication, for example. The second perimeter area 32 is rectangular in shape and is formed by perimeter thermal liner 80' and retains a beverage bottle 14. Note that adjacent walls of perimeter areas may share a perimeter liner. As shown in FIG. 6, a perimeter thermal liner 80 extends around the inside perimeter 47 of the double wall bin portion 41 and a partition thermal liner 81 extends from a first to a second end that are retained to the perimeter thermal liner 80 by connecting fasteners 84, 84'. The first perimeter area 30 and second perimeter area 32 are configured on opposing sides of the partition thermal liner 81, which may comprise an insulating material 83.

Figure 7:
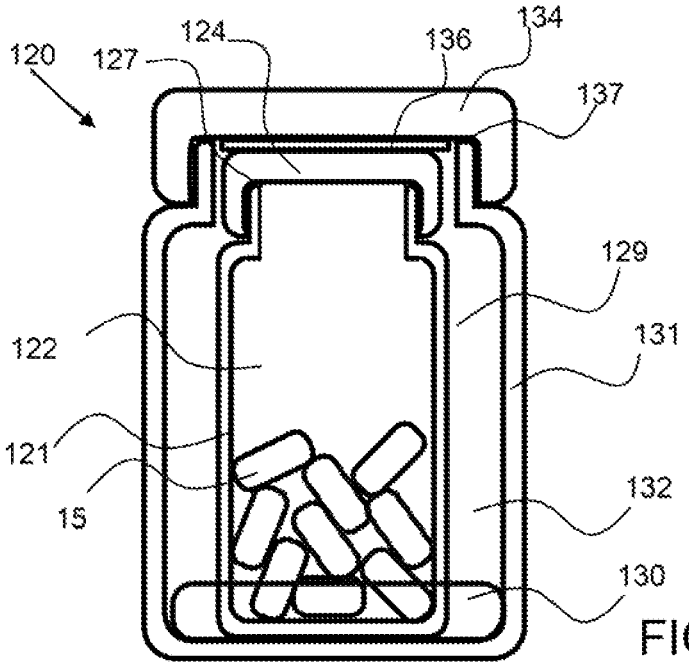
FIG. 7 shows a cross sectional view of a bottle-in-bottle used to prevent moisture from damaging an article, such as medication, within the inner bottle.

As shown in FIG. 7, a bottle-in-bottle 120 is configured to prevent moisture from damaging articles, such as medication 15 within the inner bottle 122. The inner bottle 122 is retained within the outer bottle 132. The outer bottle wall 131 extends around the inner bottle wall 121 and a void space 129 is formed therebetween. A desiccant 130, such as silica gel, may be configured in the void space to keep the relative humidity at a low level. A retainer gasket 136 is configured between the outer bottle cap 134 and inner bottle cap 124 to prevent the inner bottle from jostling. Also, the outer bottle cap may have a cap seal 137 which may be a moisture seal. Likewise, the inner bottle cap may have a moisture prevention cap seal 127. This configuration may effectively prevent moisture from damaging the articles in the inner bottle.

Figure 8:
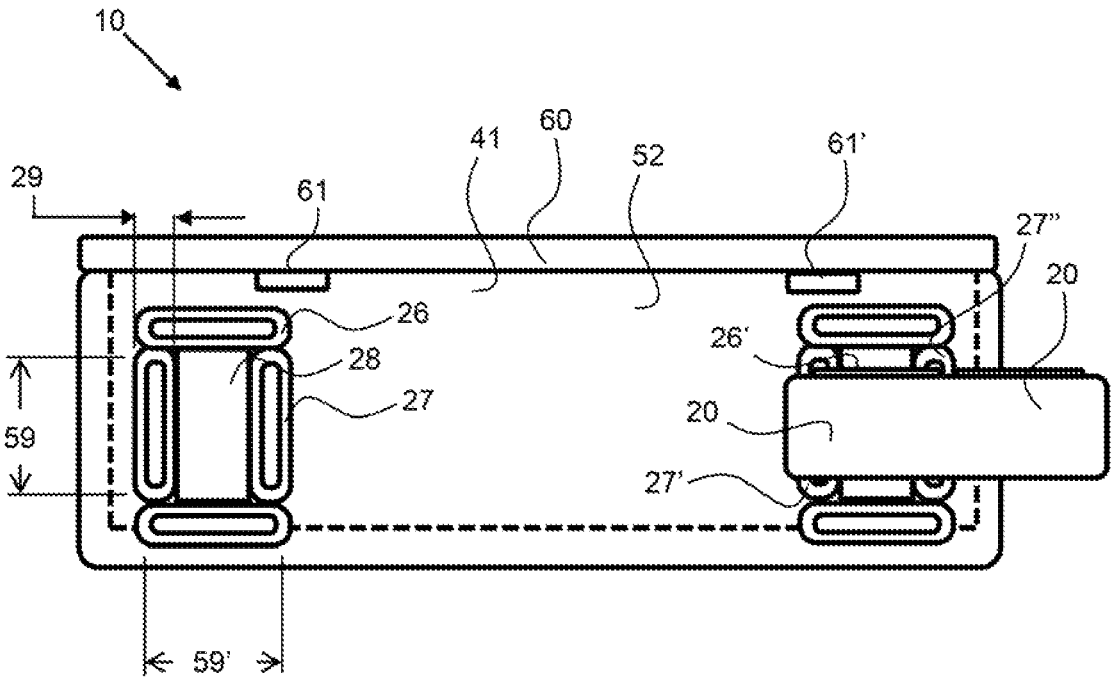
FIG. 8 shows a back view of an exemplary fanny pack system having a pair of belt attachments retained to the back side of the double wall bin portion that incorporates a plurality of loops for versatile attachment of the fanny pack to a belt.

As shown in FIG. 8, an exemplary fanny pack system 10 has a pair of belt attachments 26, 26' configured on the back side 52 of the double wall bin portion 41 for attachment of a belt 20. The exemplary belt attachment has a belt attachment plate 28 that is coupled to the double wall bin portion and a plurality, four, belt attachment loops 27. The exemplary belt attachment loops are elongated having a length 25 that is greater than a width 29, wherein the length to width ratio is about 1.5 or more or about 2.0 or more. Two of the belt attachment loops are configured on opposing sides of the plate and two are configured on opposing ends of the plate. An exemplary belt attachment 26 may have two of the belt attachment loops having a length 59 that extends along the height of the double wall bin portion or are configured on opposing sides of the plate, and two of the belt attachment loops having a length 59' that extends along the length of the double wall bin portion or are configured on opposing ends of the plate, as shown. A belt 20 is configured through the two belt attachment loops 27', 27" configured on opposing sides of the plate. Note that a belt may be configured in an orthogonal orientation through one or both of the belt attachment loops configured on the ends of the plate and may be retained around a bar or rail of a mobility aide, a walker or wheel chair, for example.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A thermal control and insulating fanny pack system comprising:
   a) a fanny pack comprising:
      i) a rigid double wall bin portion made of metal and comprising:
         an inner wall;
         an outer wall;
         a sealed insulating gap between the inner wall and outer wall that comprises a thermal insulating gas; and
         a top opening;
      ii) a cover configured to extend over the top opening of the bin portion;
      iii) a belt extending from the rigid double wall bin and configured to extend around a person's waist;
   b) a detachably attachable perimeter thermal liner that forms an enclosure containing a thermally imparting material haying thermal control properties, and wherein the perimeter thermal liner is configured around the interior perimeter of the rigid double wall bin portion and comprising an interior fastener on an inside surface;
   c) a detachably attachable base thermal liner that forms an enclosure containing a thermally imparting material having thermal control properties;
   d) an article liner configured to extend completely around an article placed in the rigid double wall bin portion, said article liner comprising an article fastener configured on an exterior surface and configured to detachably attach to the interior fastener of the perimeter thermal liner.

2. The thermal control and insulating fanny pack system of claim 1, wherein the interior fastener and the article fasteners are hook-and-loop fasteners.

3. The thermal control and insulating fanny pack system of claim 1, wherein the article liner forms an enclosure containing a thermally imparting material having thermal control properties.

4. The thermal control and insulating fanny pack system of claim 1, wherein the cover is a rigid double wall cover comprising:
   a) an inner wall;
   b) an outer wall; and
   c) a sealed insulating gap between the inner wall and outer wall.

5. The thermal control and insulating fanny pack system of claim 4, wherein the rigid double wall cover is made of metal.

6. The thermal control and insulating fanny pack system of claim 1, wherein the thermal insulating gas is selected from the group consisting of argon, helium, krypton and xenon.

7. The thermal control and insulating fanny pack system of claim 1, further comprising latches that extend between the cover and the bin portion to retain the cover in a closed position.

8. The thermal control and insulating fanny pack system of claim 1, further comprising a gasket configured between the cover and the bin portion when the cover is in a closed position.

9. The thermal control and insulating fanny pack system of claim 8, further comprising latches that extend between the cover and the bin portion to retain the cover in a closed position; and wherein the latches compress the gasket between the cover and bin portion.

10. The thermal control and insulating fanny pack system of claim 1, wherein the perimeter thermal liner extends around the inside perimeter of the rigid double wall bin portion.

11. The thermal control and insulating fanny pack system of claim 10, wherein the perimeter thermal liner comprises a connecting fastener to couple a first end to a second end of the perimeter thermal liner.

12. The thermal control and insulating fanny pack system of claim 1, wherein the rigid double wall bin portion has a curved front side.

13. The thermal control and insulating fanny pack system of claim 12, wherein the curved front side extends substantially along a radius of curvature, wherein at least 60% of the front side is curved along a radius of curvature.

14. The thermal control and insulating fanny pack system of claim 1, wherein the thermally imparting material within the perimeter thermal liner comprises a gel.

15. The thermal control and insulating fanny pack system of claim 1, further comprising an article thermal liner configured to extend around an article for retention in the bin portion.

16. The thermal control and insulating fanny pack system of claim 15, wherein the article thermal liner comprises an article fastener, and wherein the perimeter thermal liner comprises an interior fastener configured on an inside surface of the perimeter thermal liner, and wherein the article fastener is detachably attachable to the interior fastener of the base thermal liner.

17. The thermal control and insulating fanny pack system of claim 16, wherein the base thermal liner comprises an interior fastener configured on an inside surface of the base thermal liner, and wherein the article fastener is detachably attachable to the interior fastener of the base thermal liner.

18. The thermal control and insulating fanny pack system of claim 1, wherein the article thermal liner comprises an article fastener, and wherein the base thermal liner comprises an interior fastener configured on an inside surface of the base thermal liner, and wherein the article fastener is detachably attachable to the interior fastener of the base thermal liner.

19. The thermal control and insulating fanny pack system of claim 1, comprising:

a) a first perimeter area defined by a first perimeter thermal liner;

b) a second perimeter area defined at least in part by a second perimeter thermal liner.

20. The thermal control and insulating fanny pack system of claim 19, wherein a first article is retained in the first perimeter area and a second article is retained in the second perimeter area.

21. The thermal control and insulating fanny pack system of claim 1, further comprising a bottle-in-bottle comprising:

a) an outer bottle having an outer wall and outer bottle cap;

b) an inner bottle having an inner wall and inner bottle cap;

wherein the inner bottle is configured within the outer bottle to form a void space therebetween;

c) an article thermal liner that encircles the outer bottle and has fasteners that are detachably attachable so that the article is secured to a perimeter thermal liner fastener that prevents jostling and cushions the article contents from impact damage.

22. The thermal control and insulating fanny pack system of claim 21, wherein a desiccant is configured in the void space.

23. The thermal control and insulating fanny pack system of claim 22, wherein the outer bottle cap comprises a moisture seal.

24. The thermal control and insulating fanny pack system of claim 23, wherein the inner bottle cap comprises a moisture seal.

25. The thermal control and insulating fanny pack system of claim 24, wherein the outer bottle cap comprises a retainer gasket configured on an inside surface of the outer bottle cap and configured to engage with the inner bottle to retain the inner bottle in compression with the outer bottle cap.

26. The thermal control and insulating fanny pack system of claim 1, further comprising a belt attachment having at least one belt attachment loop configured vertically and one belt attachment configured horizontally.

27. The thermal control and insulating fanny pack system of claim 26, comprising a pair of belt attachment loops having a length that extends along a height of the double wall bin portion and a pair of belt attachment loops having a length that extends along a length of double wall bin portion.

* * * * *